US011872447B2

(12) United States Patent
Tsai

(10) Patent No.: US 11,872,447 B2
(45) Date of Patent: Jan. 16, 2024

(54) SKI EXERCISE MACHINE WITH DETECTIVE STEP BOARD

(71) Applicant: Yu-Lun Tsai, Taichung (TW)

(72) Inventor: Yu-Lun Tsai, Taichung (TW)

( * ) Notice: Subject to any disclaimer, the term of this patent is extended or adjusted under 35 U.S.C. 154(b) by 199 days.

(21) Appl. No.: 17/557,272

(22) Filed: Dec. 21, 2021

(65) Prior Publication Data

US 2023/0191194 A1 Jun. 22, 2023

(51) Int. Cl.
*A63B 24/00* (2006.01)

(52) U.S. Cl.
CPC .... *A63B 24/0062* (2013.01); *A63B 2220/833* (2013.01)

(58) Field of Classification Search
CPC ..... A63B 24/0062; A63B 2220/833; A63B 21/4035; A63B 21/4045; A63B 23/03541; A63B 2071/0063; A63B 2220/16; A63B 26/003; A63B 69/18; A63B 22/16; A63B 2220/40
See application file for complete search history.

(56) References Cited

U.S. PATENT DOCUMENTS 4,396,189 A * 8/1983 Jenkins ..... A63B 69/18 482/146
4,509,743 A * 4/1985 Lie ..... A63B 69/18 482/71
5,582,567 A * 12/1996 Chang ..... A63B 22/16 482/146
5,613,690 A * 3/1997 McShane ..... G06F 3/0334 428/902
6,428,451 B1 * 8/2002 Hall ..... A63G 23/00 482/79
7,008,359 B2 * 3/2006 Fan ..... A63B 22/18 482/146
7,645,221 B1 * 1/2010 Curry ..... A63B 26/003 482/79
9,731,163 B2 * 8/2017 Henson ..... A63B 22/18
10,946,247 B1 * 3/2021 Burton ..... A63B 71/0054
2007/0027009 A1 * 2/2007 Arnold ..... A63B 21/005 482/146
2008/0280740 A1 * 11/2008 Knecht ..... A63B 26/003 482/146
2008/0280741 A1 * 11/2008 Baek ..... A63B 22/14 482/146
2009/0111670 A1 * 4/2009 Williams ..... A63B 23/0464 482/146
2009/0143197 A1 * 6/2009 Chen ..... A63B 22/16 482/1
2011/0039669 A1 * 2/2011 Stewart ..... A63B 69/0053 482/146

(Continued)

*Primary Examiner* — Andrew S Lo
(74) *Attorney, Agent, or Firm* — Best & Flanagan LLP

(57) ABSTRACT

A ski exercise machine includes a main frame, a support rack mounted on the main frame, a rotation shaft module mounted on a top of the support rack, a movable step board mounted on a top of the rotation shaft module, an elastic unit mounted between the movable step board and the support rack, and at least one gyroscope mounted on the movable step board. The movable step board is movably pivoted and swung relative to the support rack. The at least one gyroscope detects and derives a swinging information of the movable step board when the movable step board is swung relative to the support rack.

8 Claims, 7 Drawing Sheets

(56) References Cited

U.S. PATENT DOCUMENTS

| | | | | |
|---|---|---|---|---|
| 2011/0256983 | A1* | 10/2011 | Malack | A63B 21/4015 482/4 |
| 2011/0312473 | A1* | 12/2011 | Chu | A63B 69/0053 482/54 |
| 2012/0264579 | A1* | 10/2012 | Klein | A63B 22/18 482/146 |
| 2019/0314676 | A1* | 10/2019 | Wilson | A63B 21/00058 |
| 2020/0101352 | A1* | 4/2020 | Liu | A63B 21/0442 |
| 2021/0245012 | A1* | 8/2021 | Kumar | A63B 21/00181 |
| 2022/0080284 | A1* | 3/2022 | Churchman | A63B 22/02 |

* cited by examiner

SKI EXERCISE MACHINE WITH DETECTIVE STEP BOARD

BACKGROUND OF THE INVENTION

1. Field of the Invention

The present invention relates to an exercising (or training or gym) device and, more particularly, to a ski exercise machine.

2. Description of the Related Art

A conventional ski exercise machine comprises a main frame, a fixed pedal, and at least one movable pedal. The main frame is placed on a flat surface and has a frame. The fixed pedal is laid on the frame. The movable pedal is also arranged on the frame. The movable pedal is juxtaposed to the fixed pedal and swings movably. Thus, when the user operates the ski exercise machine, the user steps on the movable pedal to swing movably to simulate the motion of skiing so as to achieve a training purpose. However, the movable pedal does not have a cushioning force during the swinging process so that when the user's two feet tread the movable pedal, the movable pedal directly falls down and is swung to the maximum angle, thereby easily frightening the user, and thereby easily injuring the user's ankles. In addition, the movable pedal does not have a restoring force during the swinging process so that the user's two ankles have to exert a large force to swing the movable pedal backward or in other directions. Thus, the user's two ankles are easily tired or injured. Further, the user cannot collect the swinging information or data when stepping on the movable pedal, and cannot improve the training mode.

BRIEF SUMMARY OF THE INVENTION

The primary objective of the present invention is to provide a ski exercise machine with an activated detective step board assembly.

In accordance with the present invention, there is provided a ski exercise machine comprising a main frame, a support rack mounted on the main frame, a rotation shaft module mounted on a top of the support rack, a movable step board mounted on a top of the rotation shaft module, an elastic unit mounted between the movable step board and the support rack, and at least one gyroscope mounted on the movable step board. The movable step board is movably pivoted and swung relative to the support rack with the rotation shaft module being served as an axis of the movable step board. The at least one gyroscope detects and derives a swinging information of the movable step board when the movable step board is swung relative to the support rack.

According to the primary advantage of the present invention, the elastic members of the elastic unit are mounted between the movable step board and the support rack, to provide a buffering force and a shock-absorbing effect when the movable step board is swung, to prevent the movable step board from falling accidentally, thereby preventing the user from being shocked or frightened, and thereby preventing the user's feet from being injured.

According to another advantage of the present invention, the elastic members are distributed evenly to provide an opposite pulling force to the movable step board so that the user's feet manipulate the movable step board easily and conveniently without having to exert a large force.

According to a further advantage of the present invention, the movable step board is moved and swung smoothly and steadily by provision of the elastic members.

According to a further advantage of the present invention, the swinging information of the movable step board is detected by the at least one gyroscope and is transmitted to the electronic display to facilitate the user improving the training modes.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
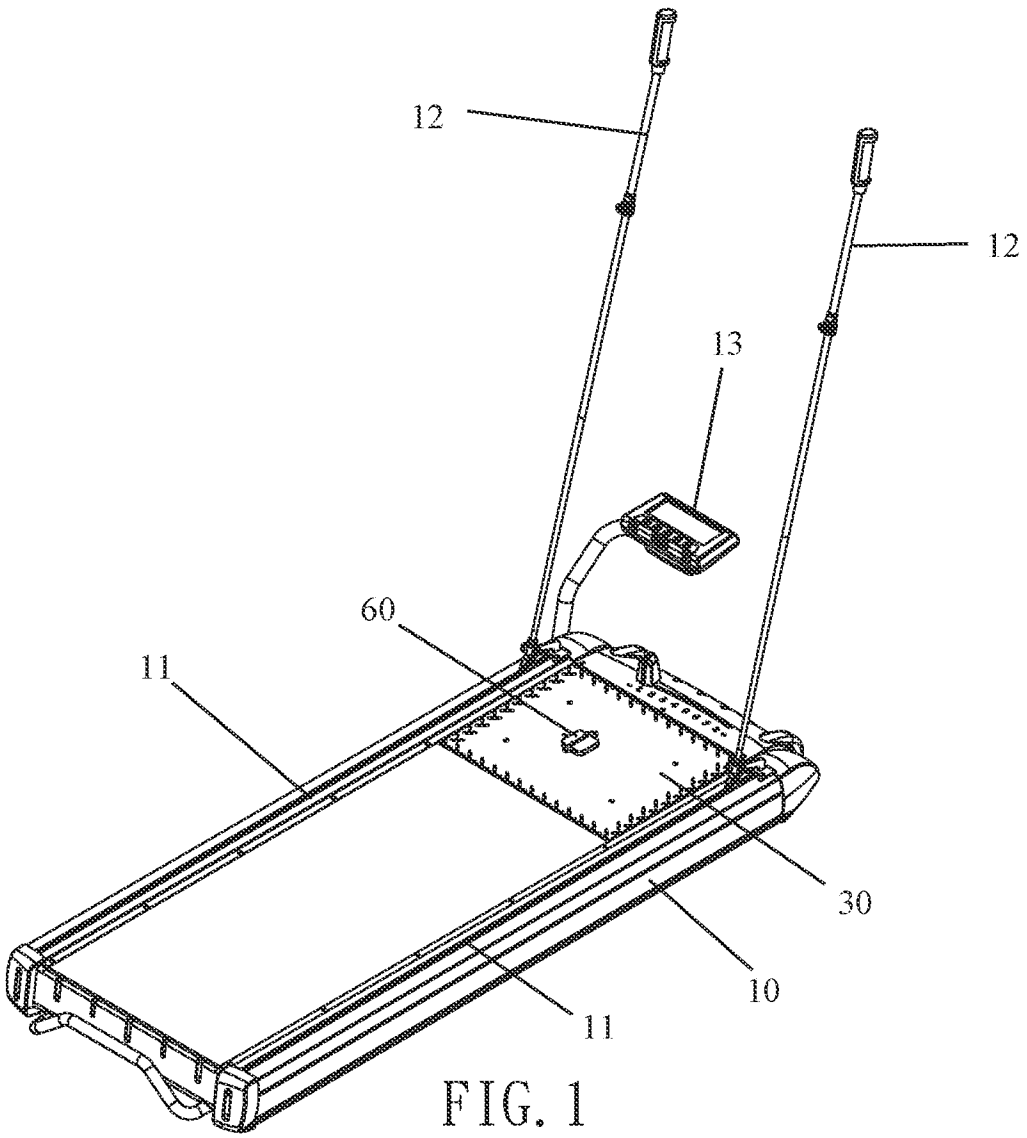
FIG. 1 is a perspective view of a ski exercise machine in accordance with the preferred embodiment of the present invention.
Figure 2:
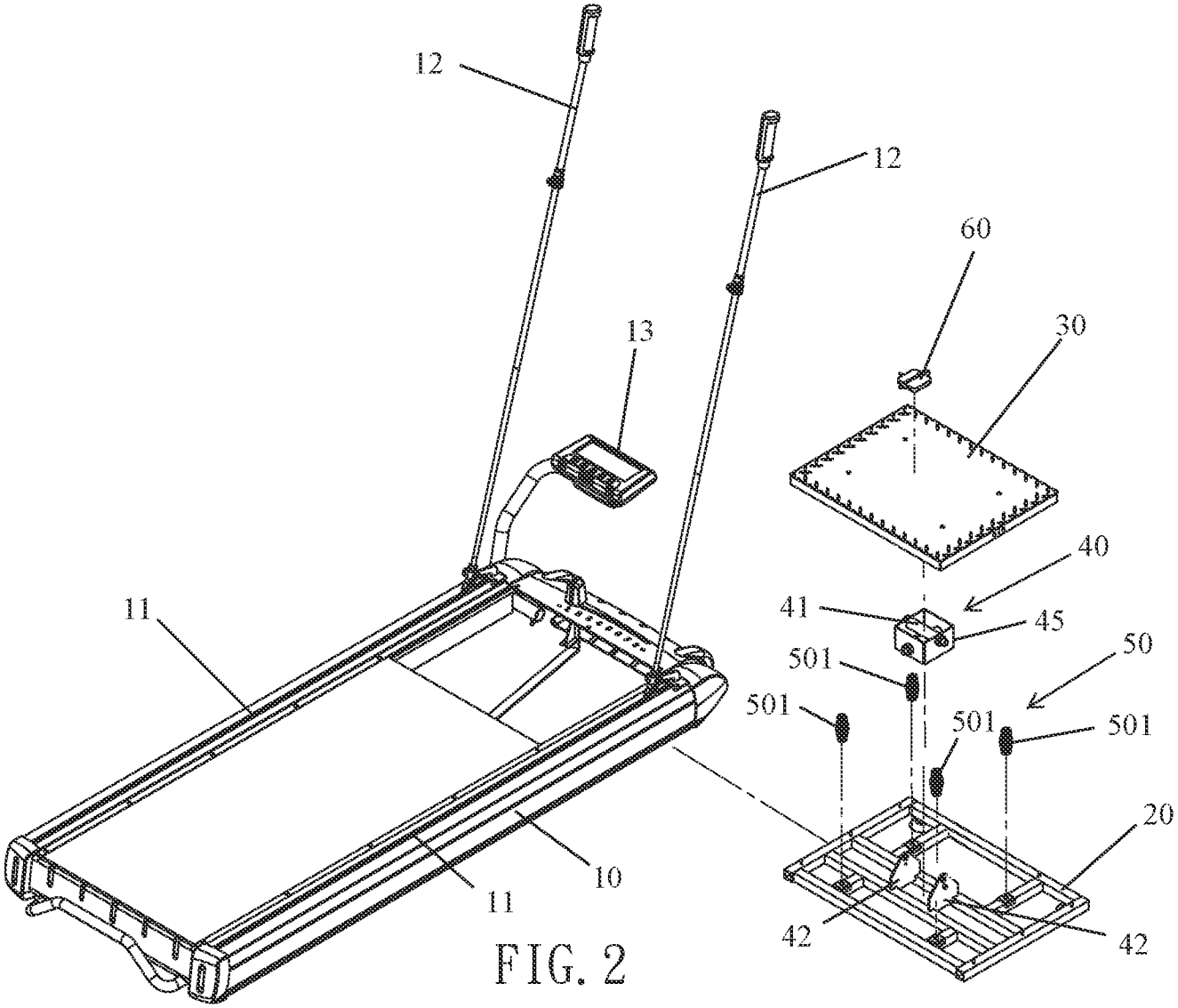
FIG. 2 is a partial exploded perspective view of the ski exercise machine in accordance with the preferred embodiment of the present invention.
Figure 3:
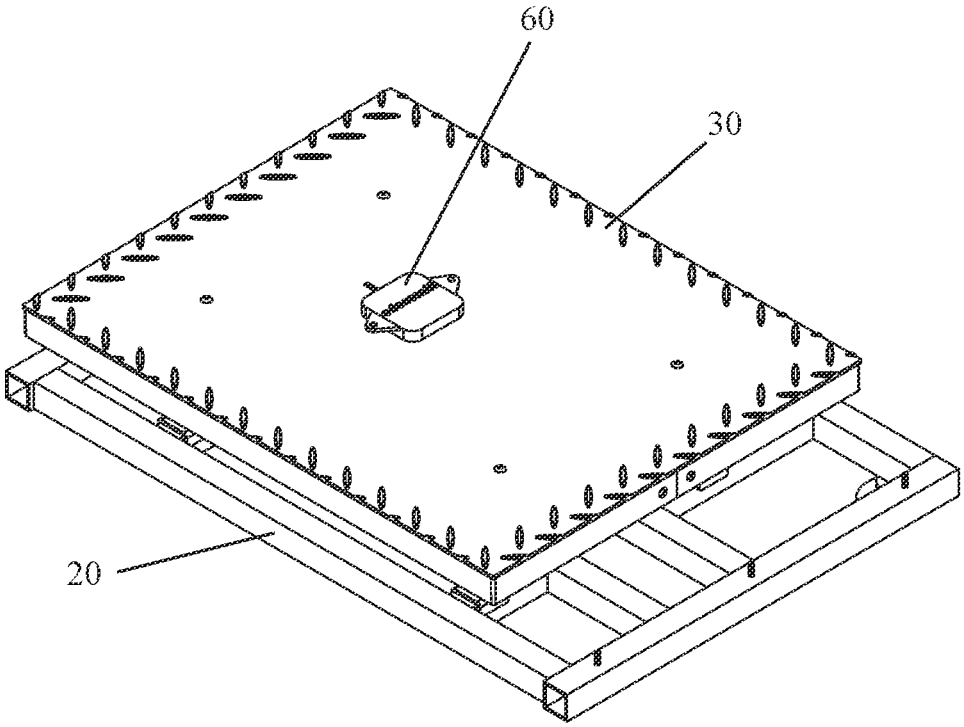
FIG. 3 is a partial perspective assembly view of the ski exercise machine in accordance with the preferred embodiment of the present invention.
Figure 4:
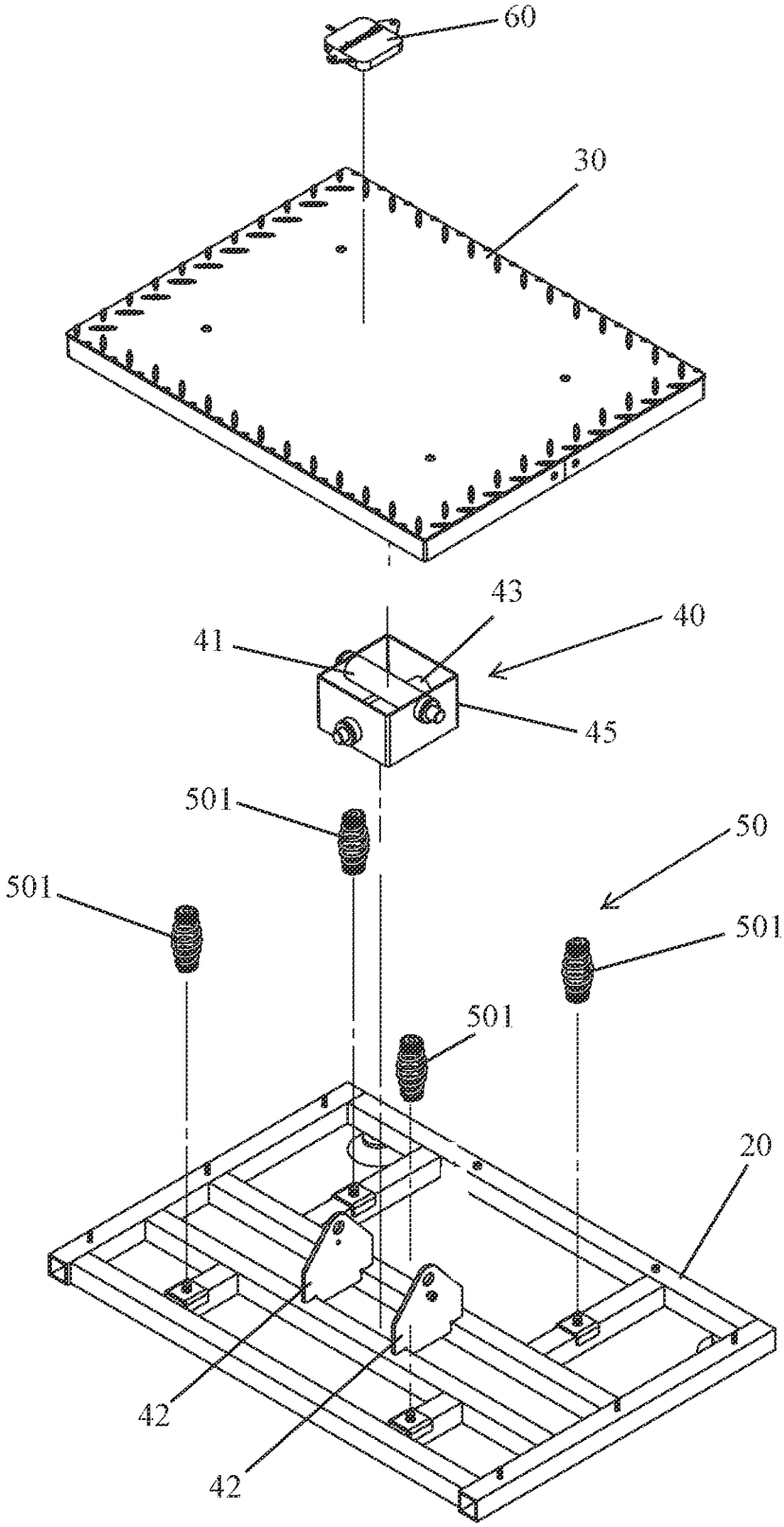
FIG. 4 is a partial enlarged exploded perspective view of the ski exercise machine in accordance with the preferred embodiment of the present invention.

Referring to the drawings and initially to FIGS. 1-5, a ski exercise machine in accordance with the preferred embodiment of the present invention comprises a main frame 10, a support rack 20 mounted on the main frame 10, a rotation shaft module 40 mounted on a top of the support rack 20, a movable step board 30 mounted on a top of the rotation shaft module 40, an elastic unit 50 mounted between the movable step board 30 and the support rack 20 to aid the swinging movement of the movable step board 30, and at least one gyroscope (or gyro) 60 or 601 mounted on the movable step board 30. The movable step board 30 is movably pivoted and swung relative to the support rack 20 with the rotation shaft module 40 being served as an axis (or a fulcrum) of the movable step board 30. The at least one gyroscope 60 or 601 detects and derives a swinging information of the movable step board 30 when the movable step board 30 is swung relative to the support rack 20.

In the preferred embodiment of the present invention, the ski exercise machine further comprises two guide tracks 11 mounted on two sides of the main frame 10 respectively, and two sliding handles 12 mounted on the two guide tracks 11 respectively. Each of the two sliding handles 12 has a lower end sliding forward and backward in one of the two guide tracks 11.

In the preferred embodiment of the present invention, the ski exercise machine further comprises an electronic display (or dashboard or instrument panel) 13 mounted on a front end of the main frame 10.

In the preferred embodiment of the present invention, the ski exercise machine further comprises multiple stands 21 (see FIG. 5) mounted on a bottom of the support rack 20 and secured to the main frame 10. Each of the stands 21 is a sucker.

Figure 5:
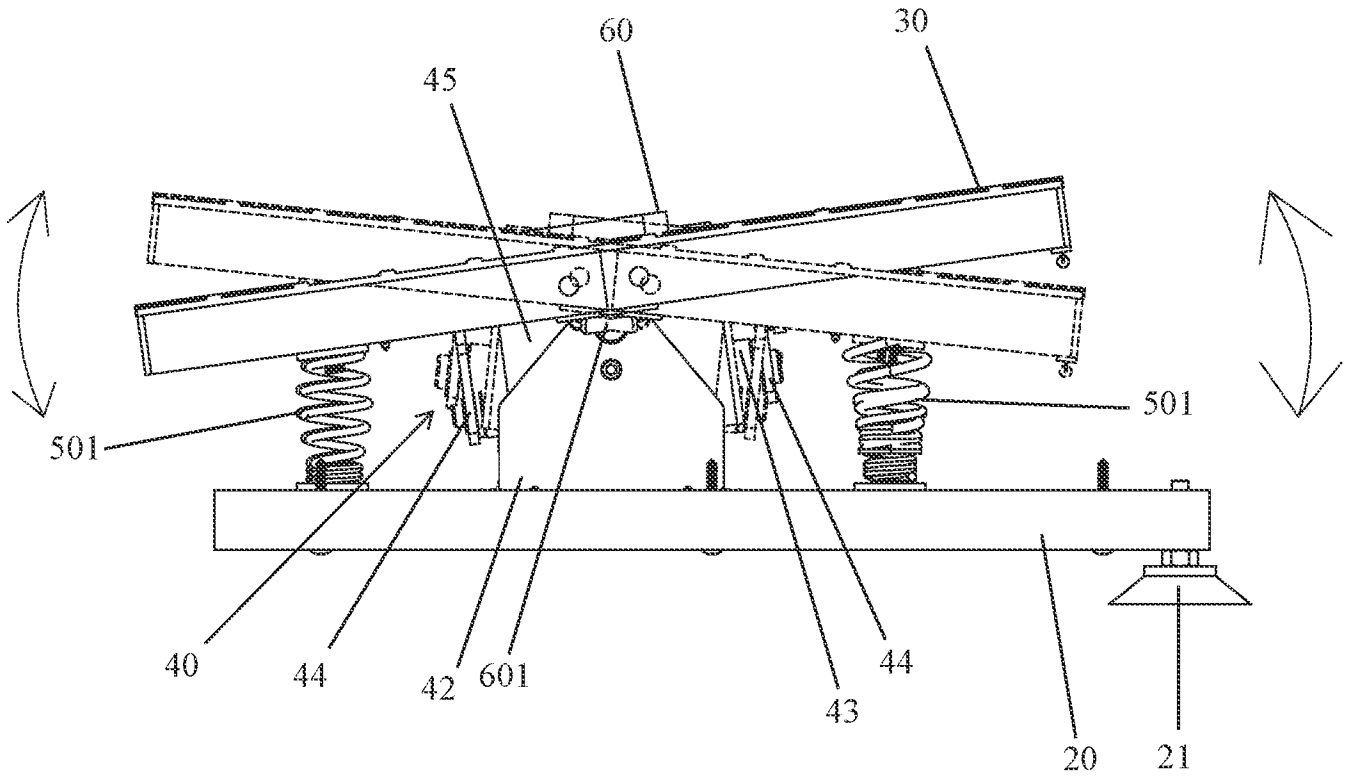
FIG. 5 is a schematic operational view showing a swinging movement of a movable step board of the ski exercise machine in accordance with the preferred embodiment of the present invention.

In the preferred embodiment of the present invention, the rotation shaft module 40 includes a swinging member 45, a first rotation shaft 41, a second rotation shaft 43, two first pivot members 42, and two second pivot members 44 (see FIG. 5). The swinging member 45 is a rectangular hollow frame (or box or case or shell). Each of the two first pivot members 42 is secured on the top of the support rack 20. Each of the two first pivot members 42 is an upright plate perpendicular to the support rack 20. Each of the two second pivot members 44 is secured on a bottom of the movable step board 30. Each of the two second pivot members 44 is an upright plate perpendicular to the movable step board 30. Each of the two second pivot members 44 is directed toward a direction perpendicular to that of each of the two first pivot members 42. The first rotation shaft 41 is pivotally (or rotatably) mounted on the swinging member 45 and has two ends pivotally connected with the two first pivot members 42 respectively. The first rotation shaft 41 is arranged in the swinging member 45 and pivotally mounted between the two first pivot members 42. Each of the two ends of the first rotation shaft 41 protrudes from the swinging member 45. The second rotation shaft 43 is pivotally (or rotatably) mounted on the swinging member 45 and has two ends pivotally connected with the two second pivot members 44 respectively. The second rotation shaft 43 is arranged in the swinging member 45 and pivotally mounted between the two second pivot members 44. Each of the two ends of the second rotation shaft 43 protrudes from the swinging member 45. The second rotation shaft 43 has a rotation direction perpendicular to that of the first rotation shaft 41.

In the preferred embodiment of the present invention, the elastic unit 50 includes multiple elastic members 501 mounted between the movable step board 30 and the support rack 20. The elastic members 501 are arranged and distributed evenly between the movable step board 30 and the support rack 20. Each of the elastic members 501 is a spring.

As shown in FIGS. 1-6, the at least one gyroscope 60 is located at a middle position of the top of the movable step board 30.

Figure 7:
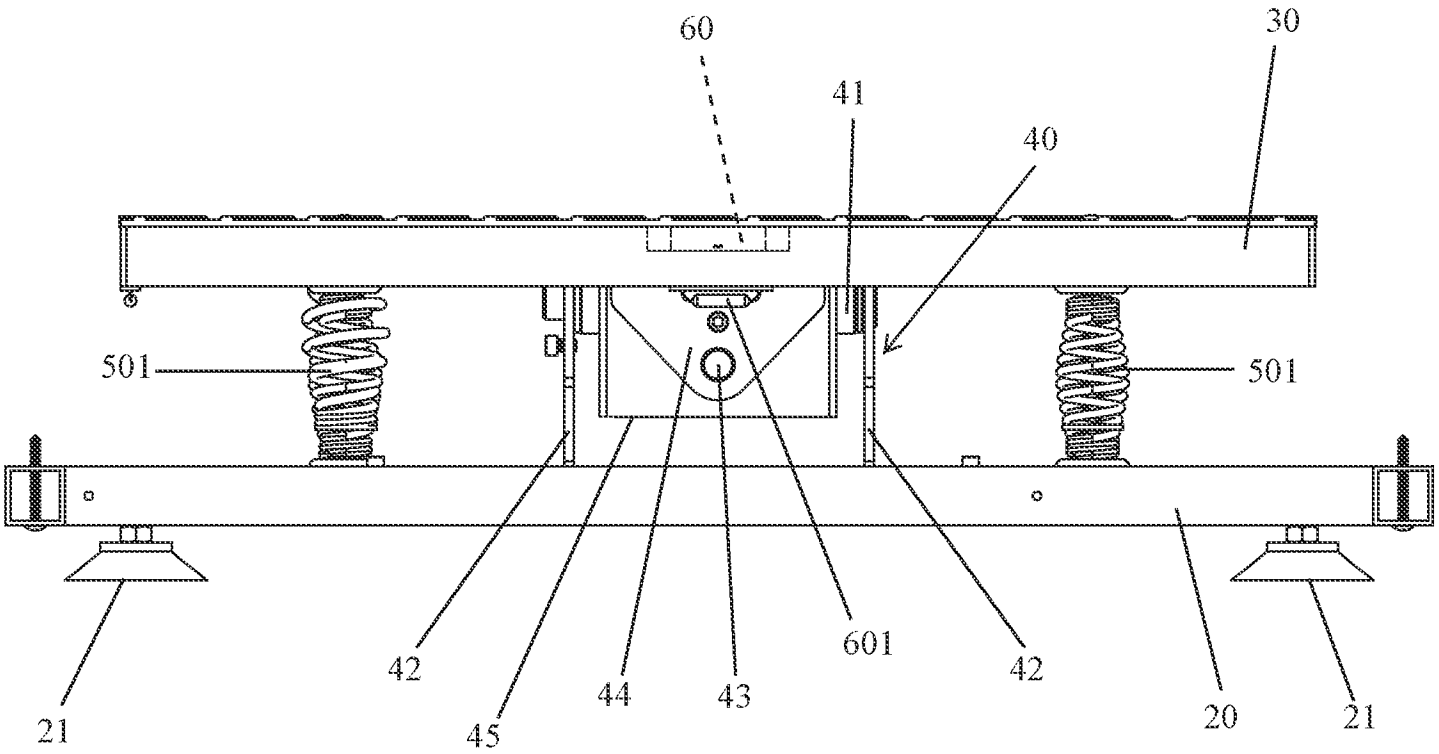
FIG. 7 is a schematic view showing a normal state of the movable step board of the ski exercise machine in accordance with the preferred embodiment of the present invention.

As shown in FIG. 7, the at least one gyroscope 60 is located at a middle position of the bottom of the movable step board 30.

Figure 6:
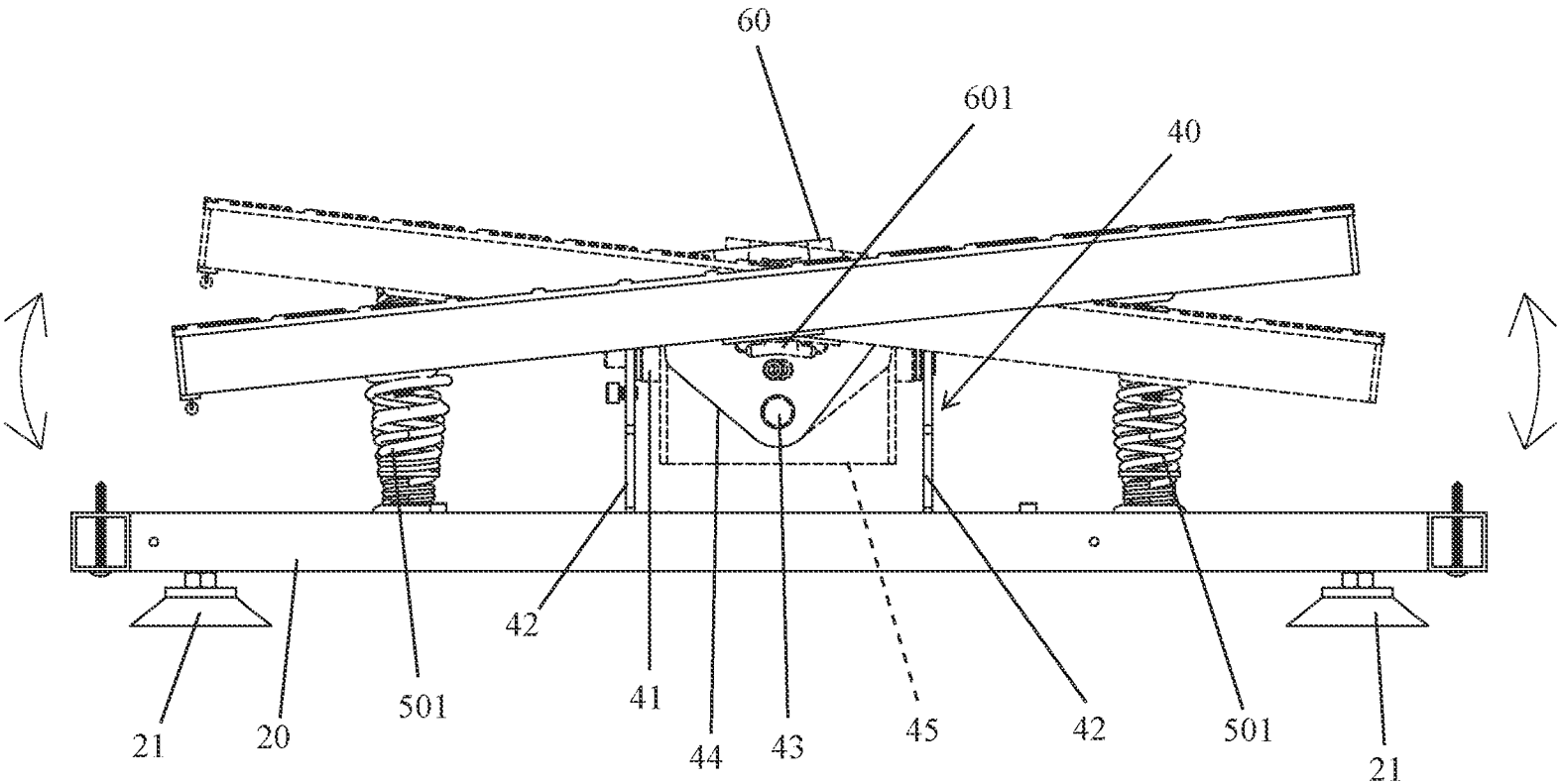
FIG. 6 is another schematic operational view showing a swinging movement of the movable step board of the ski exercise machine in accordance with the preferred embodiment of the present invention.

As shown in FIGS. 5-7, the at least one gyroscope 601 is located at an eccentric position of the bottom of the movable step board 30.

In operation, referring to FIGS. 5-7 with reference to FIGS. 1-4, the user's two feet tread and apply a force on the movable step board 30 so that the movable step board 30 is pivoted relative to the support rack 20. In such a manner, the first rotation shaft 41 is pivoted between the two first pivot members 42 so that the swinging member 45 is pivoted relative to the support rack 20 in a first direction, and the two second pivot members 44 are pivoted on the second rotation shaft 43 so that the movable step board 30 is pivoted relative to the swinging member 45 in a second direction perpendicular to the first direction. Thus, the movable step board 30 is pivoted relative to the support rack 20 in two different directions.

In addition, the at least one gyroscope 60 is mounted on the movable step board 30. Thus, when the movable step board 30 is swung relative to the support rack 20, the at least one gyroscope 60 detects and derives a swinging information of the movable step board 30. Then, the swinging information detected by the at least one gyroscope 60 is transmitted to the electronic display 13.

It is appreciated that, the at least one gyroscope 60 is located at a middle position of the top of the movable step board 30, or located at a middle position of the bottom of the movable step board 30, or located at an eccentric position of the bottom of the movable step board 30. Thus, when the number of the at least one gyroscope 60 is increased, the swinging information detected by the at least one gyroscope 60 is more precise.

In practice, when the movable step board 30 is pivoted forward and downward, the elastic members 501 at the front side of the movable step board 30 provide a buffering force to the movable step board 30, and the elastic members 501 at the rear side of the movable step board 30 provide a restoring force and a pulling force to the movable step board 30. On the contrary, when the movable step board 30 is pivoted backward and downward, the elastic members 501 at the rear side of the movable step board 30 provide a buffering force to the movable step board 30, and the elastic members 501 at the front side of the movable step board 30 provide a restoring force and a pulling force to the movable step board 30.

Alternatively, when the movable step board 30 is pivoted leftward and downward, the elastic members 501 at the left side of the movable step board 30 provide a buffering force to the movable step board 30, and the elastic members 501 at the right side of the movable step board 30 provide a restoring force and a pulling force to the movable step board 30. On the contrary, when the movable step board 30 is pivoted rightward and downward, the elastic members 501 at the right side of the movable step board 30 provide a buffering force to the movable step board 30, and the elastic members 501 at the left side of the movable step board 30 provide a restoring force and a pulling force to the movable step board 30.

Accordingly, the elastic members 501 of the elastic unit 50 are mounted between the movable step board 30 and the support rack 20, to provide a buffering force and a shock-absorbing effect when the movable step board 30 is swung, to prevent the movable step board 30 from falling accidentally, thereby preventing the user from being shocked or frightened, and thereby preventing the user's feet from being injured. In addition, the elastic members 501 are distributed evenly to provide an opposite pulling force or a restoring force to the movable step board 30 so that the user's feet manipulate the movable step board 30 easily and conveniently without having to exert a large force. Further, the movable step board 30 is moved and swung smoothly and steadily by provision of the elastic members 501. Further, the swinging information of the movable step board 30 is detected by the at least one gyroscope 60 and is transmitted to the electronic display 13 to facilitate the user improving the training modes. Further, the swinging member 45 of the rotation shaft module 40 has a frame structure. The two ends of the first rotation shaft 41 are pivotally mounted on the swinging member 45, and are pivotally connected with the two first pivot members 42 respectively. The two ends of the second rotation shaft 43 are pivotally mounted on the swinging member 45, and are pivotally connected with the two the two second pivot members 44 respectively. Each of the two first pivot members 42 is secured on the top of the support rack 20. Each of the two second pivot members 44 is secured on a bottom of the movable step board 30. Each of the two second pivot members 44 is directed toward a direction perpendicular to that of each of the two first pivot members 42. Thus, when the movable step board 30 is stepped by the user and operated during a long-term utilization, the rotation shaft module 40 is better than a conventional universal connector and is able to withstand the user's weight so that the ski exercise machine is not worn out easily to enhance the lifetime of the ski exercise machine.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A ski exercise machine comprising:

a main frame;

a support rack mounted on the main frame;

a rotation shaft module mounted on a top of the support rack;

a movable step board mounted on a top of the rotation shaft module;

an elastic unit mounted between the movable step board and the support rack; and at least one gyroscope mounted on the movable step board;

wherein:

the movable step board is movably pivoted and swung relative to the support rack with the rotation shaft module being served as an axis of the movable step board; and the at least one gyroscope detects and derives a swinging information of the movable step board when the movable step board is swung relative to the support rack;

further comprising:

two guide tracks mounted on two sides of the main frame respectively; and two sliding handles mounted on the two guide tracks respectively;

wherein:

each of the two sliding handles has a lower end sliding forward and backward in one of the two guide tracks.

2. The ski exercise machine as claimed in claim 1, further comprising:

an electronic display mounted on a front end of the main frame.

3. The ski exercise machine as claimed in claim 1, further comprising:

multiple stands mounted on a bottom of the support rack and secured to the main frame;

wherein:

each of the stands is a sucker.

4. The ski exercise machine as claimed in claim 1, wherein:

the elastic unit includes multiple elastic members mounted between the movable step board and the support rack;

the elastic members are arranged evenly between the movable step board and the support rack; and each of the elastic members is a spring.

5. The ski exercise machine as claimed in claim 1, wherein the at least one gyroscope is located at a middle position of a top of the movable step board.

6. The ski exercise machine as claimed in claim 1, wherein the at least one gyroscope is located at a middle position of a bottom of the movable step board.

7. The ski exercise machine as claimed in claim 1, wherein the at least one gyroscope is located at an eccentric position of a bottom of the movable step board.

8. A ski exercise machine comprising:

a main frame;

a support rack mounted on the main frame;

a rotation shaft module mounted on a top of the support rack;

a movable step board mounted on a top of the rotation shaft module;

an elastic unit mounted between the movable step board and the support rack; and at least one gyroscope mounted on the movable step board;

wherein:

the movable step board is movably pivoted and swung relative to the support rack with the rotation shaft module being served as an axis of the movable step board;

the at least one gyroscope detects and derives a swinging information of the movable step board when the movable step board is swung relative to the support rack;

the rotation shaft module includes a swinging member, a first rotation shaft, a second rotation shaft, two first pivot members, and two second pivot members;

the swinging member is a hollow frame;

each of the two first pivot members is secured on the top of the support rack;

each of the two second pivot members is secured on a bottom of the movable step board;

each of the two second pivot members is directed toward a direction perpendicular to that of each of the two first pivot members;

the first rotation shaft is pivotally mounted on the swinging member and has two ends pivotally connected with the two first pivot members respectively; and the second rotation shaft is pivotally mounted on the swinging member and has two ends pivotally connected with the two second pivot members respectively.

* * * * *